US008397654B2

(12) United States Patent
van Diepen et al.

(10) Patent No.: US 8,397,654 B2
(45) Date of Patent: Mar. 19, 2013

(54) GRATE PLATE ARRANGEMENT

(75) Inventors: Nicolaas van Diepen, Garbsen (DE); Richard Schneider, Linsburg (DE); Sando Klaas Windmöller, Neustadt a.Rbge (DE)

(73) Assignee: IKN GmbH, Neustadt (DE)

( * ) Notice: Subject to any disclaimer, the term of this patent is extended or adjusted under 35 U.S.C. 154(b) by 151 days.

(21) Appl. No.: 12/700,368

(22) Filed: Feb. 4, 2010

(65) Prior Publication Data

US 2010/0206288 A1 Aug. 19, 2010

(30) Foreign Application Priority Data

Feb. 17, 2009 (DE) ..... 10 2009 009 285

(51) Int. Cl.
*F23H 7/08* (2006.01)
*B65G 25/04* (2006.01)

(52) U.S. Cl. ..... 110/281; 110/328; 126/152 B; 126/174; 198/750.2

(58) Field of Classification Search ..... 126/152 B, 126/152 R, 153, 154, 160, 163 R, 174, 175, 126/541; 110/267, 268, 281, 282, 283, 284, 110/289, 290, 291, 346; 198/860.3, 860.5, 198/861.1, 750.1, 750.2, 750.3
See application file for complete search history.

(56) References Cited

U.S. PATENT DOCUMENTS 1,983,709 A 12/1934 Schmidt
3,987,738 A 10/1976 Korting
4,002,148 A 1/1977 Harding
4,201,545 A 5/1980 Riechert
4,239,029 A 12/1980 Martin et al.
4,250,819 A 2/1981 Pauli
4,257,465 A * 3/1981 Berg ..... 411/147
4,337,857 A * 7/1982 Schneider ..... 198/773
4,471,704 A 9/1984 John et al.
4,498,634 A 2/1985 Nelson et al.
4,537,140 A 8/1985 Baker
4,600,380 A 7/1986 von Wedel
4,671,310 A 6/1987 Henninger
4,694,757 A 9/1987 Hawkins et al.

(Continued)

FOREIGN PATENT DOCUMENTS

DE 10118440 10/2002
DE 10 2004 040 048 A1 2/2006

(Continued)

OTHER PUBLICATIONS

Von Wedel, Clinker Cooling with Coanda Effect, Zerment, Kalk, Gips, Apr. 1992, p. 1-14, Neustadt, Germany.

*Primary Examiner* — Kenneth Rinehart
*Assistant Examiner* — David J Laux
(74) *Attorney, Agent, or Firm* — Quarles & Brady LLP

(57) ABSTRACT

A grate plate arrangement for stepped reciprocating grates includes a grate plate with a front plate fastened to a front wall in the direction of conveyance. The grate plate includes an adjustment plate being clamped between the front plate and the front wall of the grate plate for adjusting a motion gap between the front end of the grate plate and the following grate plate in the direction of conveyance which forms the next grate step. The adjustment plate is calibrated with the front plate still only loosely assembled, in its vertical position that forms the motion gap, and is held in this position by clamping the front plate.

12 Claims, 3 Drawing Sheets

U.S. PATENT DOCUMENTS

| | | | | | |
|---|---|---|---|---|---|
| 4,732,561 | A | | 3/1988 | Eiring et al. | |
| 4,771,710 | A | * | 9/1988 | Cocchi | 110/281 |
| 4,870,913 | A | * | 10/1989 | Schneider | 110/299 |
| 4,995,757 | A | | 2/1991 | Prescott | |
| 5,154,560 | A | * | 10/1992 | Copito | 411/266 |
| 5,174,747 | A | | 12/1992 | Massaro, Jr. et al. | |
| 5,299,555 | A | | 4/1994 | Claes | |
| 5,322,434 | A | | 6/1994 | Milewski et al. | |
| 5,549,471 | A | | 8/1996 | Tegtmeier et al. | |
| 5,551,356 | A | | 9/1996 | Post | |
| 5,572,937 | A | | 11/1996 | Tegtmeier et al. | |
| 5,575,642 | A | | 11/1996 | Willis et al. | |
| 5,626,089 | A | | 5/1997 | Schneider et al. | |
| 5,724,898 | A | | 3/1998 | von Bockh et al. | |
| 5,862,906 | A | | 1/1999 | von Wedel | |
| 6,155,184 | A | | 12/2000 | Stiefel | |
| 6,266,883 | B1 | | 7/2001 | Heinemann et al. | |
| 6,302,038 | B1 | * | 10/2001 | Seo et al. | 110/281 |
| 6,497,456 | B1 | * | 12/2002 | Masuda et al. | 297/480 |
| 6,745,893 | B2 | | 6/2004 | von Wedel | |
| 7,021,928 | B1 | | 4/2006 | Fehsenmayr et al. | |
| 7,114,612 | B2 | | 10/2006 | Meyer et al. | |
| 7,156,223 | B2 | | 1/2007 | Meyer et al. | |
| 7,219,610 | B2 | | 5/2007 | von Wedel | |

FOREIGN PATENT DOCUMENTS

| | | |
|---|---|---|
| DK | 9901403 | 4/2001 |
| EP | 0 549 816 A1 | 7/1993 |
| EP | 0 740 766 B1 | 11/1996 |
| EP | 1475594 | 11/2004 |

* cited by examiner

GRATE PLATE ARRANGEMENT

CROSS-REFERENCE TO RELATED APPLICATION

This application claims the priority benefit of German Patent Application No. 10 2009 009 285.4 filed on Feb. 17, 2009, the entirety of which is fully incorporated herein by reference.

STATEMENT CONCERNING FEDERALLY SPONSORED RESEARCH OR DEVELOPMENT

Not Applicable.

FIELD OF THE INVENTION

The present invention relates to a grate plate arrangement for stepped reciprocating grates including a box-like grate plate with a front plate fastened to the front wall in conveying direction, and means for adjusting a motion gap between the front end of the grate plate and the following grate plate in conveying direction.

BACKGROUND OF THE INVENTION

Stepped reciprocating grates are used for the continuous conveyance and simultaneous cooling or other types of treatment of bulk materials that are deposited on the grate and to which cooling air or another treatment gas is fed from below through blower openings in the grate surface.

A plurality of grate plates located side-by-side next to each other on a grate carrier form a grate row, and a plurality of grate rows arranged one behind the other in the direction of conveyance form the grate. On reciprocating grates, individual grate rows can be moved forward and backward in the direction of conveyance, as a result of which the bulk materials carried on the grate are conveyed forward along the grate. For example, FIG. 3 of the present application displays FIG. 1 of DE 10 2004 040 048 and discloses this grate floor arrangement with a step grate of grate plates 2 (the original reference characters being modified to coincide with this disclosure). The grate plates 2 are mounted in subsequent rows on grate carriers 44. Some rows oscillate as indicated by the double headed arrow 52 for transporting bulk material on the grate floor.

"Box-like" grate plates form essentially closed, flat boxes with a top wall, a bottom wall, two side walls, a front wall and a back wall. Cooling air, for example, is fed to the grate plate through an opening in the bottom wall, the cooling air is blown into the bulk material through blower openings that are formed through the top wall.

The top walls and front walls that are in constant contact with the bulk material, in particular on the moving grate rows, are subject to a particularly high degree of wear, especially when the bulk material being transported is very hot and abrasive.

EP 0 549 816 B2 teaches that the top wall can be formed by blades of a heat-resistant and abrasion-resistant material which lie on the box which is open on top, whereby blower slots are left open between the blades. EP 0 740 766 B1 further teaches that the front wall is protected by a front plate of an appropriately resistant material fastened to it.

A particular structural problem associated with reciprocating grates of the described type are the so-called motion gaps. To prevent damage caused by friction in the area of the overlap between two grate plates that are moving relative to one another, which would produce increased wear and require increased drive power, a gap is left between the underside of one grate plate and the upper side of the successive grate plate in the direction of conveyance. This gap is generally cleared by blowing cooling air or gas through it. The gap should be configured as narrow as possible, so that the flow of air or gas that is discharged through it on the one hand, and the quantity of bulk material that falls through it on the other hand do not become uncontrollably large. An additional requirement is that the motion gap must also remain as constant as possible, even when subjected to high mechanical and thermal stresses and after extended operation, and/or it must be possible to readjust the gap easily, if necessary. Therefore, two important operating characteristics of a reciprocating grate depend on accurately calibrated motion gaps, namely the grate resistance and the amount of material passing through the gap.

The above referenced EP 0 740 766 B1 teaches that the motion gap can be adjusted by means of a vertically adjustable front plate located on the front wall. For this purpose, the front plate is provided with a slot for a fixing a bolt that extends in the vertical direction, for vertical adjustment. It became evident with this construction, on the one hand, the front plate must be welded to the adjacent front blade to permanently fix the front plate, and on the other hand, the fixing bolt must be welded to the front plate to prevent it from rotating. This requires that the blade, the front plate and the fixing bolt are made of weldable materials, which limits the choice of materials. Generally, the welding joints must also be protected against wear by cover welds. Welds are frequently defective and therefore not fail-safe. A major disadvantage of the welds is, however, that they cannot be non-destructively removed, which makes the adjustment or replacement of the front plates more difficult. Moreover, in the known design, the bolt head of the fixing bolt retaining the front plate is subjected to a high degree of wear so that after extended operation it can no longer be suitably removed with a tool.

DE 10 2004 040 048 A1 describes a vertically adjustable front plate that can be attached to the front wall, in which the threaded bolt provided for fastening the front plate or the bolt head is protected against direct contact with the bulk material by a separate cover. As shown in FIG. 3 of the present application, DE 10 2004 040 048 illustrates that the front plate 24 has an oblong hole 30, permitting adjustment of the height of the front plate 24 and thereby the height of motion gap 51 between two subsequent grate plates. The bolt head can, for example, be countersunk in a recess that is formed on the front plate 24 and protected by a cover. Here, too, it became evident that at least the cover must be welded to the front plate 24 to keep the cover in its closed position. In one embodiment, the fixing bolt 26 is prevented from rotating by flat faces formed in the inside of the cover that fit against the flats of the bolt head. However, it is necessary that the threaded bolt 26 is rotated to a specified position for the flats of the bolt head to be in line with the flanks of the cover, which is generally not corresponding with optimum pretensioning of the bolt 26.

SUMMARY OF THE INVENTION

The purpose of the present invention is to create a grate plate arrangement for stepped reciprocating grates including a box-like grate plate with a front plate fastened to the front wall in the direction of conveyance, and means for adjusting a motion gap between the front end of the grate plate and the following grate plate in conveying direction, which permits a simple and precise adjustment of the motion gap, and which requires no welds to fix any structural elements, so that on the one hand, non-weldable materials can be used, and on the other hand, non-destructive removal of the structural elements.

The invention teaches that this requirement is resolved in that between the vertically mounted non-adjustable front plate and the front wall, an adjustment plate that extends at least across the width of the grate plate, is arranged such that the lower edge of the adjustment plate forms a specific motion gap with the upper side of the following grate plate.

Accordingly, the motion gap is no longer adjusted by a vertical adjustment of the front plate, so that it can be secured in its specified operating position by means of one or more fixing bolts, without the need for additional retention by welding. Therefore, it can be made of an abrasion-resistant material that is optimized for the intended purpose. To loosen the front plate, for example, to replace it or to readjust the adjustment plate, it is only necessary to loosen the fixing bolts. Special embodiments of the invention are provided for the protection of and to prevent of the fixing bolts from rotating, these are described in greater detail below.

Because essentially no forces act on the adjustment plate, it is sufficient that according to one embodiment of the invention, said adjustment plate is non-positively clamped between the front plate and the front wall of the grate plate.

In order to ensure a tilt-free vertical adjustment of the adjustment plate, an additional embodiment of the invention provides means for vertical guidance of the adjustment plate. The guides are on the adjustment plate, on the front plate and/or on the front wall of the grate plate. The guide means permit vertical adjustment, but prevent a lateral displacement or tilting of the adjustment plate.

To facilitate the assembly of the front plate and the adjustment plate on the grate plate, as well as the adjustment of the adjustment plate for the formation of the motion gap, it is further provided that stop means are provided on the adjustment plate on the one hand, and on the front plate and/or the front wall of the grate plate on the other hand, to limit the vertical displacement of the adjustment plate. This measure allows for loose pre-assembly of the front plate and the adjustment plate away from the step grate, preventing the adjustment plate from dropping out of the top or from the bottom. The actual adjustment and clamping of the adjustment plate can then be done on site, i.e. on the grate plate that forms the grate surface.

The grate plates are generally arranged with a lateral gap in relation to the adjacent grate plate, to allow for lateral thermal expansion. In an additional embodiment of the invention, to bridge this gap and thus prevent uncontrolled leakage of the cooling air or gas respectively in this way, the adjustment plate projects laterally beyond the width of the grate plate, for example, such that it touches the respective adjacent adjustment plate.

In an additional structural embodiment of the invention it is foreseen that the front plate is bolted to the front wall of the grate plate by means of a plurality of hexagon socket head fixing bolts, such as Allen screws, the bolt heads of which are located in recesses that are present on the front side of the front plate. Fixing bolts with a hexagon socket head make it possible to provide a cylindrical bolt head that can be received in a circular recess slightly larger than the bolt head, so that the bolt head is largely protected against contact with the bulk material and thus against wear; in this manner, the fixing bolt can also be loosened again with an Allen wrench after extended use.

The fixing bolts can, for example, be screwed into threaded bores that are formed in the front wall of the grate plate, for example, although this requires appropriate machining of the grate plates. In a preferred embodiment of the invention, the fixing bolts extend through access openings in the front plate and in the front wall of the grate plate that are aligned with each other and are engaged in nuts that are held and rotationally locked in pockets on the reverse side of the front wall. This arrangement eliminates a machining step for the grate plates, i.e. the cutting of screw threads in the grate plate. The nuts themselves are standard parts and are located inside the grate plate in an area that is cooled by the cooling air or gas, as a result of which they are not exposed to any particular stresses. The fixing bolts can be easily protected in a known manner to prevent them from coming loose by means of lock washers assigned to the bolt heads.

As already explained earlier in the foregoing, the adjustment plate is guided vertically on the front plate, for example, and its vertical movement is limited by stops. One structural solution provides that the access openings in the front plate each are surrounded by a beaded edge on their rear face, and the adjustment plate further has a pinnacle structure which is open on top, whereby the pinnacles engage between the beaded edges and are vertically guided by them. Furthermore, there is at least one recess on the adjustment plate and a projection on the rear of the front plate that engages in said recess with some vertical play, which forms the stop means to limit the vertical displacement of the adjustment plate, as is explained in greater detail below by reference to an example embodiment.

If the fastening of the grate plate to the assigned grate carrier is to be performed according to EP 0 740 766 B1 by means of a clamping bolt that extends in the longitudinal direction inside the grate plate and a claw, a further embodiment of the invention therewith provides that this clamping bolt is formed as a separate threaded bolt which is located completely in the interior of the grate plate and supported on a bracket that is fastened to the bottom wall, the bolt being arranged such in a way that is aligned with the access openings of one of the fixing bolts and can be actuated through these access openings. This clamping bolt is preferably also a hexagon socket head bolt with a hexagon socket head caliber which is preferably smaller than that of the fixing bolts, so that an actuator tool which fits through the assigned access opening can be used for its actuation.

BRIEF DESCRIPTION OF THE DRAWINGS

An exemplary embodiment of the invention is illustrated in the drawing and is described in greater detail below. In the figures.

DETAILED DESCRIPTION OF THE PREFERRED EMBODIMENT

Figure 1:
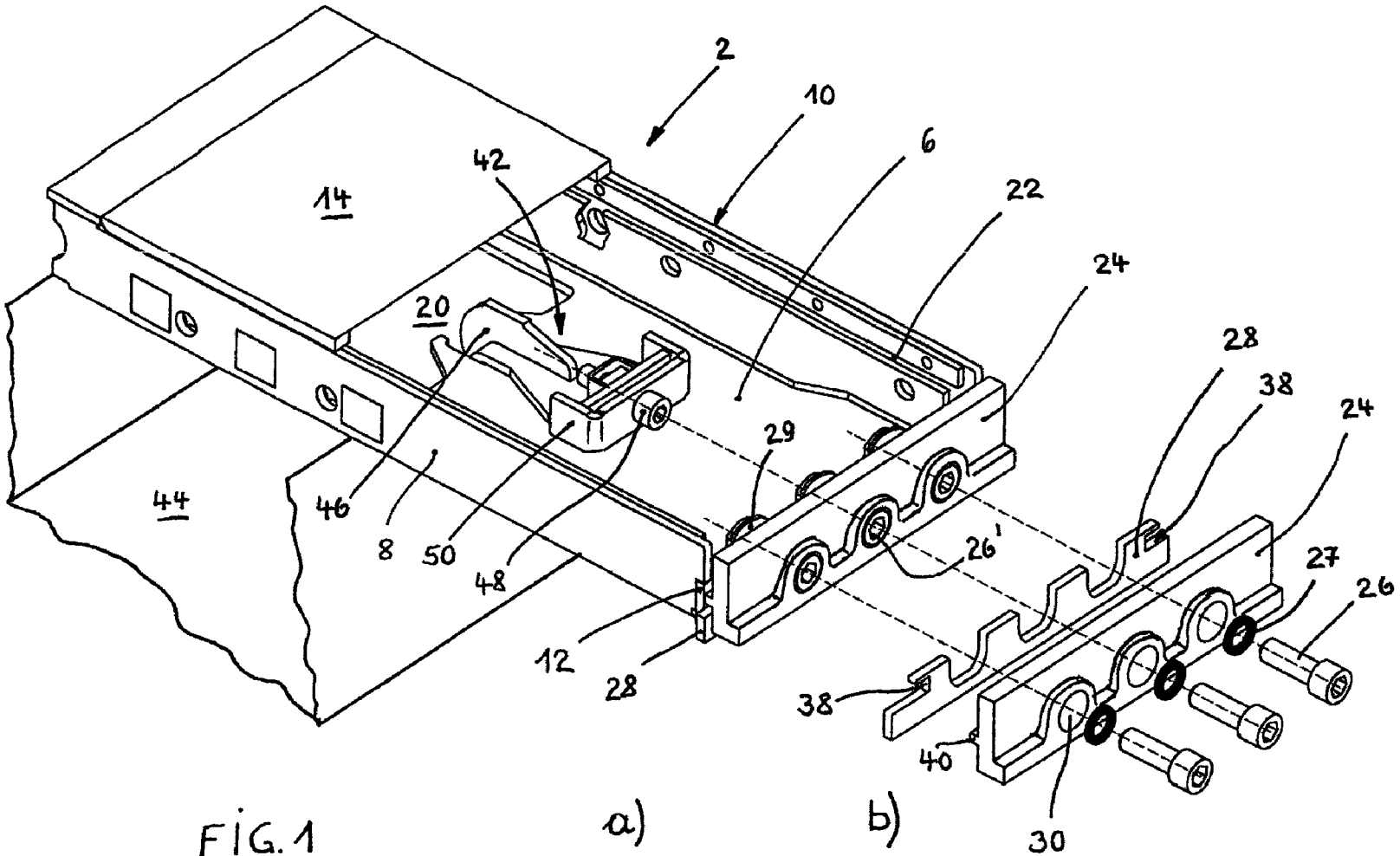
FIG. 1*a* is a perspective representation of a grate plate, which is at least partly open on top to provide a view of a device for clamping the grate plate with a front plate bolted onto its front wall.
FIG. 1*b* shows an individual front plate viewed from the front, with an assigned fixing bolt.

The grate plate 2 illustrated in FIGS. 1*a* and 2*a* is designed approximately in the shape of a box, with a top wall 4, a bottom wall 6, two side walls 8, 10, a rear wall not visible in the figures and a front wall 12.

Figure 2:
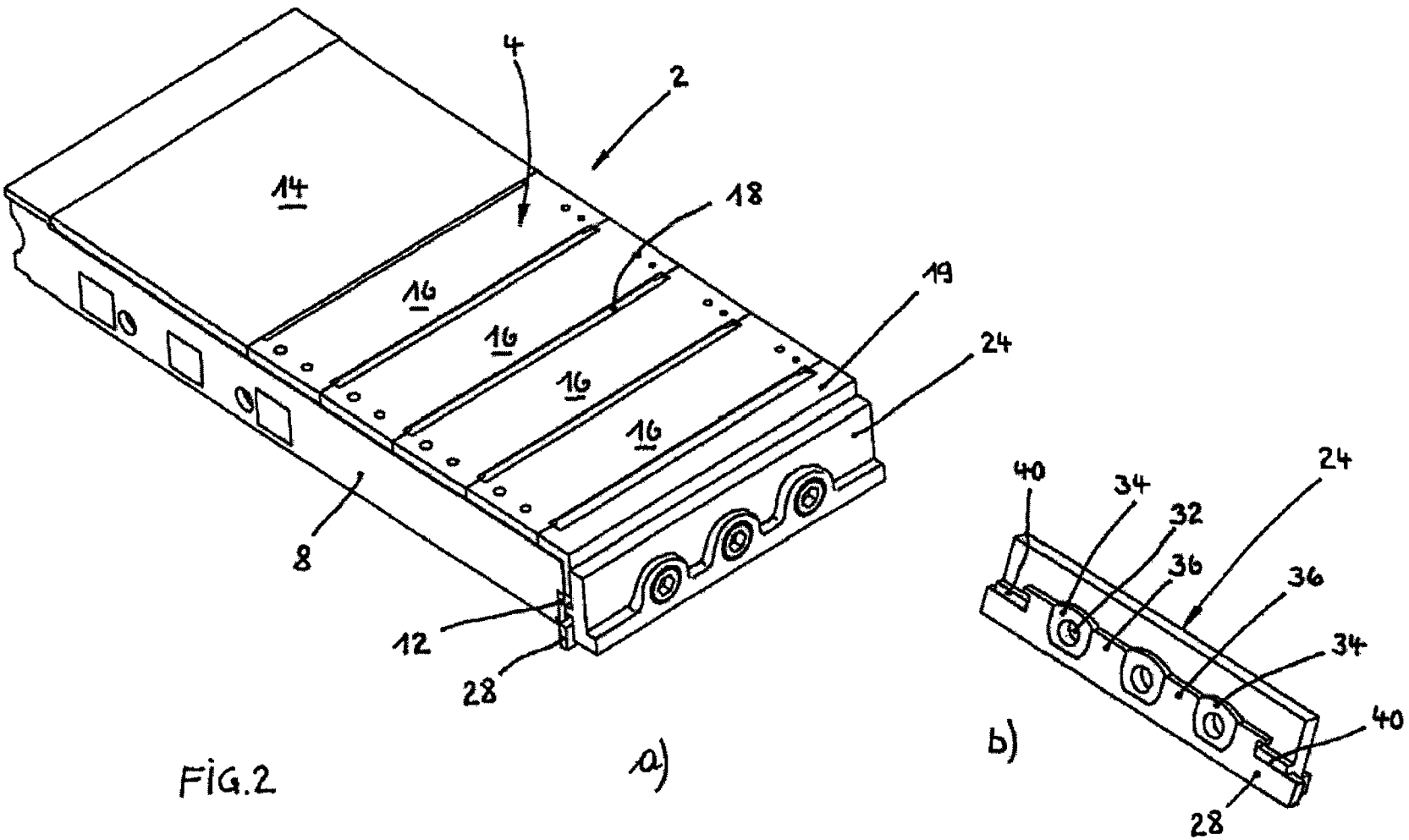
FIG. 2*a* is a perspective view of a fully assembled grate plate.
FIG. 2*b* shows an individual front plate viewed from the rear, with an adjustment plate attached to it.
Figure 3:
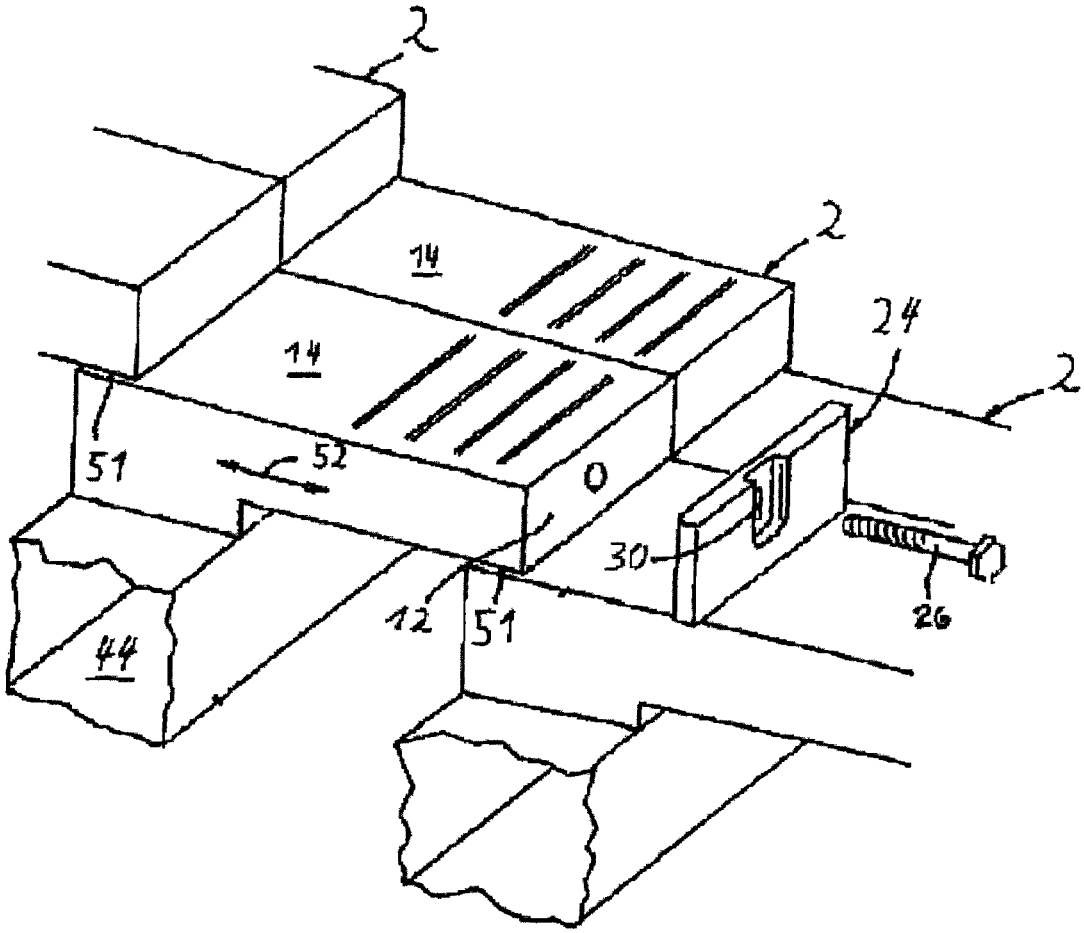
FIG. 3 PRIOR ART
FIG. 3 shows a typical step grate plate arrangement of the prior art.

As particularly shown in FIG. 2, the top wall 4 consists essentially of a closed initial blade 14, which corresponds approximately to the area of the overlap with the preceding grate plate (not shown), a plurality of middle blades 16, between each of which a blower slot 18 is left open, and an angular final blade 19, which forms the closure of the top wall 4 and the upper area of the front wall 12.

The bottom wall 6 has in its rear area, with which it rests on a grate carrier 44, an opening 20, by means of which cooling air is introduced into the grate plate, for example. This cooling air flows through the blower slots 18 into the bulk material lying on the grate plate.

The side walls 8, 10 have on each of their inner sides a guide slot 22, into which guide lugs that are formed on the lateral edges of the blades 16 which when inserted from the front are engaged in a manner which is known and is therefore not presented in greater detail.

In the illustrated exemplary embodiment, the lower portion of the front wall 12 which is fixed to the grate plate 2 extends to approximately one-half the height of the grate plate, so that the guide grooves 22 are accessible from the front side of the grate plate 2. These guide grooves, after the insertion of the initial blade 14 and the middle blades 16, are closed by the final blade 19.

A front plate 24 is bolted onto the front wall 12 by means of three fixing bolts 26. For example, the fixing bolts 26 can be screwed into threaded borings that are formed in the front wall 12, or nuts 29 that are non-rotatably located in pockets formed on the rear of the front wall, as illustrated in FIG. 1*a*.

An adjustment plate 28 is non-positively clamped between the front plate 24 and the front wall 12, so that its bottom edge forms a specified motion gap with the upper side of the subsequent grate plate, as described in greater detail with reference to FIG. 2*b*.

As shown in FIGS. 1 and 2, the fixing bolts 26 are developed as hexagon socket head fixing bolts, whereby the bolt heads of the fixing bolts 26 are each held in countersunk recesses 30 that are formed in the front side of the front plate 24, as particularly shown in FIG. 1*b*. In this manner, the bolt heads are largely protected against contact with the bulk material on the grate, so that even after extended operation, they can be loosened using a suitable tool (Allen wrench).

FIG. 2*b* shows the front plate 24 from the rear. It can be seen that the access openings 32 for the access of the fixing bolts 26 are respectively surrounded by a beaded edge 34 which acts as guide means for the vertical guidance of the adjustment plate 28. The adjustment plate 28 has a pinnacle structure which is open toward the top, whereby the pinnacles 36 each engage between the beaded edges and can be vertically guided on them.

Moreover, recesses 38 are formed on the adjustment plate 28 (see FIG. 1*b*), into each of which a projection 40 which is formed on the rear of the front plate 24 engages with vertical play. The recesses 38 and the assigned projections 40 thereby thus form stop means to limit the vertical adjustment of the adjustment plate 28.

The front plates with the adjustment plates loosely attached to them, can be loosely bolted on site, i.e. on the grate plates that are placed on a grate carrier 44, to the respective front walls of the grate plates, after which the motion gap between the adjustment plate and the subsequent grate plate can be calibrated by means of a gauge, for example, and the fixing bolts in the front plate can then be tightened, and the adjustment plate fixed in its calibrated position.

FIG. 1*a* shows a device 42 for clamping the grate plate 2 onto the grate beam 44, which is indicated schematically only. A claw 46 that grips around the front edge of the opening 20 in the bottom wall 6 and a top edge of the grate carrier 44 is clamped by means of a clamping bolt 48, which is not illustrated in detail, and which is supported on a support bracket 50, which is fastened to the bottom wall 6. The clamping bolt 48 is arranged so that it aligns with the middle fixing bolt 26', and in particular with the access openings for this fixing bolt. The clamping bolt 48 is also formed as a hexagon socket head bolt, preferably with a smaller caliber than the fixing bolts, so that it can be actuated through the access openings by means of an Allen wrench. One advantage of the arrangement described is that the clamping bolt 48 is located in the cooled interior of the grate plate and therefore undergoes essentially no thermal expansion during operation. Moreover, with appropriate configuration, both the clamping bolt 48 as well as the fixing bolts 26 can be equipped with the same hexagon socket caliber, so that they can be actuated by means of the same tool.

The fixing bolts 26 can be secured against rotation and locked by means of the assigned lock washers 27, for example.

A preferred embodiment of the invention has been described in considerable detail. Many modifications and variations to the preferred embodiment described will be apparent to those of ordinary skill in the art. Therefore, the invention should not be limited to the embodiment described, but should be defined by the claims that follow.

The invention claimed is:

1. A grate plate arrangement for stepped reciprocating grates, said grate plate arrangement comprising:

a grate plate including a front wall, with a front plate fastened to the front wall in a direction of conveyance; and means for adjusting a motion gap between the front end of the grate plate and a following grate plate in the direction of conveyance which forms a next grate step, said means for adjusting the motion gap including an adjustment plate between the front plate and the front wall of the grate plate, said adjustment plate extending at least across the width of the grate plate and located so that a lower edge of the adjustment plate forms a specified motion gap with an upper side of the following grate plate;

wherein the front plate is bolted onto the front wall of the grate plate thereby clamping the adjustment plate between the grate plate and the front plate.

2. The grate plate arrangement as claimed in claim 1, in which the adjustment plate is clamped between the front plate and the front wall of the grate plate.

3. The grate plate arrangement as claimed in claim 1, including interacting-guide means on the adjustment plate and on the front plate and/or the front wall of the grate plate which provide vertical guidance of the adjustment plate.

4. The grate plate arrangement as claimed in claim 1, including interacting stop means on the adjustment plate and the front plate and/or the front wall of the grate plate which limit the vertical movement of the adjustment plate.

5. The grate plate arrangement as claimed in claim 1, in which the adjustment plate projects laterally beyond the width of the grate plate to bridge a gap to a laterally adjacent grate plate.

6. The grate plate arrangement as claimed in claim 1, in which the front plate is bolted to the front wall of the grate plate by means of a plurality of hexagon socket head fixing bolts, the bolt heads of which are held in recesses formed on the front side of the front plate.

7. The grate plate arrangement as claimed in claim 6, in which the fixing bolts are each extending through access openings in the front plate and access openings in the front wall of the grate plate that align with each other and said fixing bolts engage into nuts that are rotationally locked in recessed receptacles on the rear of the front wall.

8. The grate plate arrangement as claimed in claim 6, in which the fixing bolts are rotationally locked in position by means of lock washers assigned to the bolt heads.

9. The grate plate arrangement as claimed in claim 7, in which the access openings of the front plate are each enclosed on their rear by edge beading, and that the adjustment plate has a pinnacle structure that is open toward the top, where the pinnacles extend between the edge beadings and are vertically guided on them.

10. The grate plate arrangement as claimed in claim 7, in which at least one recess is formed on the adjustment plate and a projection is formed on the rear of the front plate that engages in at least one recess with vertical play, which are forming the stop means to limit the vertical adjustment of the adjustment plate.

11. The grate plate arrangement as claimed in claim 1, including a clamping bolt which is arranged completely inside the grate plate and extends in the longitudinal direction inside the grate plate to clamp the grate plate onto a grate carrier, wherein the clamping bolt is developed as a separate threaded bolt that is supported on a support bracket which is fastened to a bottom wall, so that the clamping bolt aligns with an access opening of a fixing bolt for fixing the front plate to the front wall, such that the clamping bolt can be actuated through the access opening.

12. The grate plate arrangement as claimed in claim 11, in which the clamping bolt is formed as a hexagon socket head bolt with a hexagon socket caliber that corresponds to that of the fixing bolt.

* * * * *